US009284759B2

(12) United States Patent
Raatikainen

(10) Patent No.: US 9,284,759 B2
(45) Date of Patent: Mar. 15, 2016

(54) LOCKING SYSTEM OF THE PASSIVE DOOR BLADE OF A DOUBLE DOOR

(75) Inventor: Juha Raatikainen, Kontiolahti (FI)

(73) Assignee: Abloy Oy, Joensuu (FI)

( * ) Notice: Subject to any disclaimer, the term of this patent is extended or adjusted under 35 U.S.C. 154(b) by 0 days.

(21) Appl. No.: 13/201,993

(22) PCT Filed: Mar. 23, 2010

(86) PCT No.: PCT/FI2010/050228

§ 371 (c)(1),
(2), (4) Date: Aug. 17, 2011

(87) PCT Pub. No.: WO2010/109070

PCT Pub. Date: Sep. 30, 2010

(65) Prior Publication Data

US 2011/0298224 A1 Dec. 8, 2011

(30) Foreign Application Priority Data

Mar. 27, 2009 (FI) ..... 20095321

(51) Int. Cl.

| | |
|---|---|
| ***E05C 1/02*** | (2006.01) |
| ***E05C 7/04*** | (2006.01) |
| ***E05C 9/20*** | (2006.01) |
| *E05B 9/08* | (2006.01) |
| *E05B 63/00* | (2006.01) |
| *E05C 9/04* | (2006.01) |

(52) U.S. Cl.

CPC ... *E05C 7/04* (2013.01); *E05C 9/20* (2013.01); *E05B 9/08* (2013.01); *E05B 63/0056* (2013.01); *E05C 9/04* (2013.01); *Y10T 292/0961* (2015.04)

(58) Field of Classification Search

CPC ..... E05C 1/10; E05C 9/02; E05C 1/04; E05C 7/04; E05C 9/04; E05C 9/20; E05B 59/00; E05B 56/1086; E05B 9/08; E05B 63/0056; Y10T 292/0961

USPC ..... 292/32, 41, 137, 161, 162, 166, 145, 292/174; 70/108, 109, 110, 111

See application file for complete search history.

(56) References Cited

U.S. PATENT DOCUMENTS

| | | | | |
|---|---|---|---|---|
| 1,427,991 | A * | 9/1922 | Whittaker | 292/172 |
| 3,759,074 | A * | 9/1973 | Prahl | 70/143 |
| 4,643,005 | A * | 2/1987 | Logas | 70/95 |
| 5,290,077 | A * | 3/1994 | Fleming | 292/35 |

(Continued)

FOREIGN PATENT DOCUMENTS

| | | |
|---|---|---|
| EP | 0 286 042 | 4/1988 |
| EP | 0 874 118 | 4/1998 |

(Continued)

*Primary Examiner* — Nathan Cumar

(74) *Attorney, Agent, or Firm* — Muncy, Geissler, Olds & Lowe, P.C.

(57) ABSTRACT

The invention comprises a lock body (20) and two pull bars (23, 24). The arrangement further an installation frame (14, 44) for the lock body (20), attachment ends (25) in the ends facing the lock body (20) of the pull bars (23, 24) and an attachment part (30) in the lock body (20). The installation frame (14, 44) is provided with attachment arrangements (16, 45) for fastening the installation frame to the passive door blade as well as with support parts (18) for the attachment ends (25) of the pull bars. The attachment parts (30) are arranged movably in the height direction of the lock body (20) and the attachment parts comprise mating surfaces (31, 40) for the attachment ends (25).

21 Claims, 5 Drawing Sheets

(56) References Cited

U.S. PATENT DOCUMENTS

| | | | | |
|---|---|---|---|---|
| 5,373,716 | A * | 12/1994 | MacNeil et al. | 70/109 |
| 5,595,076 | A * | 1/1997 | Weinerman et al. | 70/208 |
| 5,722,704 | A * | 3/1998 | Chaput et al. | 292/26 |
| 5,911,763 | A * | 6/1999 | Quesada | 70/120 |
| 6,209,931 | B1 * | 4/2001 | Von Stoutenborough et al. | 292/160 |
| 2005/0166647 | A1 | 8/2005 | Walls et al. | |
| 2009/0019779 | A1 * | 1/2009 | Nakanishi et al. | 49/449 |

FOREIGN PATENT DOCUMENTS

| | | | |
|---|---|---|---|
| EP | 1801325 | | 6/2007 |
| FR | 2741650 | | 5/1997 |
| FR | 2 800 117 | A1 | 4/2001 |
| FR | 2 826 683 | | 1/2003 |
| GB | 2 156 896 | | 10/1985 |
| WO | WO 2004/083575 | A1 | 9/2004 |
| WO | WO 2007/000760 | A2 | 1/2007 |
| WO | WO 2008/153707 | A2 | 12/2008 |

* cited by examiner

LOCKING SYSTEM OF THE PASSIVE DOOR BLADE OF A DOUBLE DOOR

FIELD OF INVENTION

The present invention relates to locking and opening the passive door blade of a double door. In other words, the invention relates to pull bars and a central lock to be installed in the passive door.

BACKGROUND ART

Figure 1:
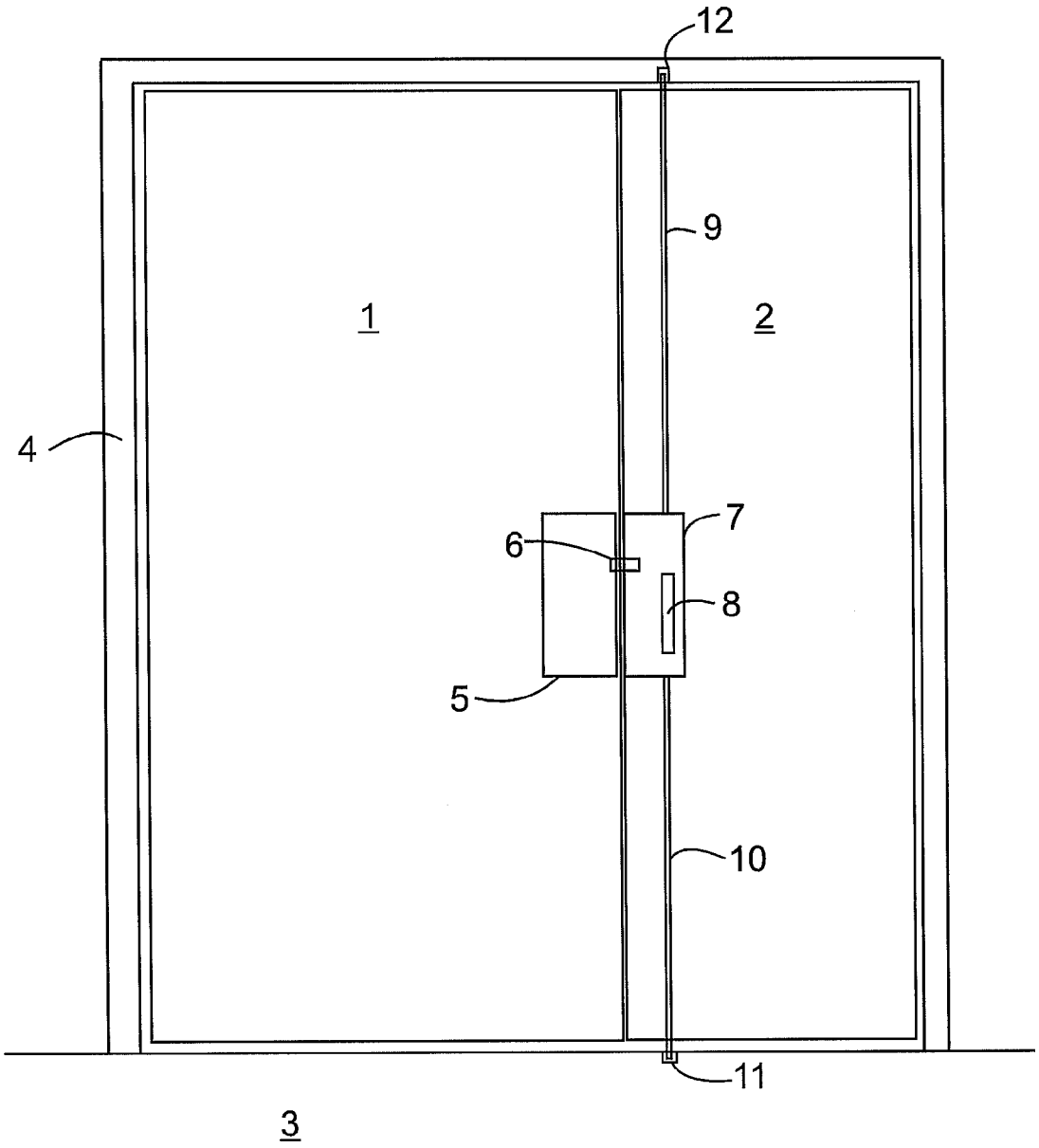

FIG. 1 illustrates a known way of locking the passive door of a double door. The double door consists of an active door blade 1 and a passive door blade 2. The active door blade and the passive door blade are also called the active door and the passive door. The active door blade is the door for normal usage, used when the doorway is passed through when not carrying larger loads. In case larger items must be transported through the doorway, such as during moving, opening the active door blade does not necessarily form a large enough opening. In such case the passive door blade is opened as well. Usually the passive door blade is locked to the jamb structure 4 of the doorway and the floor level 3.

The active door blade 1 and the passive door blade 2 are rotatably attached to the jamb structure 4 of the doorway by means of hinges. Usually the active door blade 1 comprises a lock 5 comprising a bolt 6. When the active door 1 is locked, the bolt 6 is partially inside the striker lock body 7, thus locking the active door to the passive door. The striker lock body is also called a striker lock and vice versa, because in practice the body comprises the lock functions. Because the passive door 2 is locked to the jamb structure 4 of the doorway and the floor level 3, the passive door cannot rotate and neither can the active door locked to the passive door. It can be said that in normal use the passive door is a part of the jamb structure of the doorway 4. The locking of the active door 1 is released normally and the door is opened normally.

The striker lock body 7 is combined with pull bars 9, 10 installed in the passive door 2 and locking the passive door to the jamb structure of the doorway and to the floor. Recesses 12, 11, into which the ends of the pull bars are located when the passive door is locked, are arranged in the jamb structure 4 and the floor level 3. A release means 8 is arranged in the striker lock body for pulling the pull bars towards the inside of the passive door so that the ends of the pull bars move away from the recesses 11, 12 of the frame structure and the floor level. The name of the pull bars is derived from this action. When the pull bars are pulled inside the passive door, the passive door can be opened, i.e. rotated. A typical release means 8 comprises a hand-turnable lever. In some known solutions the release means 8 is not located in connection with the striker lock body of the passive door but instead it is formed as a separate unit being in connection with the pull bars. The pull bars can also be moved back to the extended position away from the inside of the passive door by using the release means 8, whereby the passive door can be locked back to the jamb structure and the floor level.

There also are solutions in which the ends 9, 10 of the pull bars are in connection with the upper and lower lock installed in the passive door. Thereby the bolts of the upper and lower locks lock the passive door to the jamb structure and the floor level instead of the ends of the pull bars. The operation of the upper and lower locks can be controlled by means of the release means 8 via the pull bars 9, 10.

The striker lock body 7 of the locking system of the passive door is installed first. Subsequent to this the pull bars 9, 10 are installed by pushing them inside the passive door from the upper edge and the lower edge. Support structures used for supporting the pull bars to the passive door, if any, are installed in connection with the ends of the pull bars. Prior to installation the necessary installation recesses are arranged to the passive door for the central lock and the pull bars.

Should it be desired to exchange or service the striker lock body 7, the passive door must be removed from the hinges and removed from the doorway in order to allow removal of the pull bars from the door. The striker lock body can be removed from the passive door only after the removal of the pull bars. As the removal of the door from the doorway requires a lot of space, it causes disadvantages to users. Further, removing the door even for a short time can be a considerable disadvantage. For example, if the door is an double out door, removing the door in the winter or in windy weather is not advantageous. A practical solution is to install a reserve passive door for the duration of service/exchange of the striker lock body. The whole passive door complete with the striker lock body to be serviced/exchanged can be transported to the service company, whereby only the reserve door remains on location for the duration of the service. The striker lock body can also be removed on the spot and be serviced/exchanged there or it can be transferred to the service company. This can, however, cause disadvantages to the users of the doorway as the passive door remains on location and the service person needs space for the work. It can be said that servicing/exchanging the striker lock body is difficult and relatively expensive, especially if the door is transported to the service company and back.

BRIEF DESCRIPTION OF THE INVENTION

The aim of the invention is to provide a locking system for the passive door that is easier to service and replace. The aim is achieved as described in the independent claim. The dependent claims describe the various embodiments of the invention.

The system according to the invention comprises a lock body 20 and two pull bars 23, 24. The system further comprises an installation frame 14, 44 for the lock body 20, attachment ends 25 in the ends of the pull bars 23, 24 adjacent the lock body 20 and an attachment part 30 in the lock body 20. The lock body 20 includes a front plate 21 and a main body portion 20A disposed perpendicular to and extending from the front plate. The installation frame 14 includes a main frame portion 14A and a side ortion 14B disposed perendicular to and extending from the main frame portion.

The installation frame 14, 44 has attachment means 16, 45 for fastening the installation frame to the passive door blade as well as support parts 18 for the attachment ends 25 of the pull bars. The attachment parts 30 are arranged movably in the height direction of the lock body 20 and the attachment parts comprise mating surfaces 31, 40 for the attachment ends 25. The installation frame is the first to be installed in the passive door blade. It allows positioning the pull bars in the correct places. The pull bars are installed next.

Subsequent to installing the pull bars the lock body can be pushed into the installation frame and fastened to the passive door blade. The moving attachment parts connect the attachment ends of the pull bars to the lock body.

LIST OF FIGURES

Figure 2:
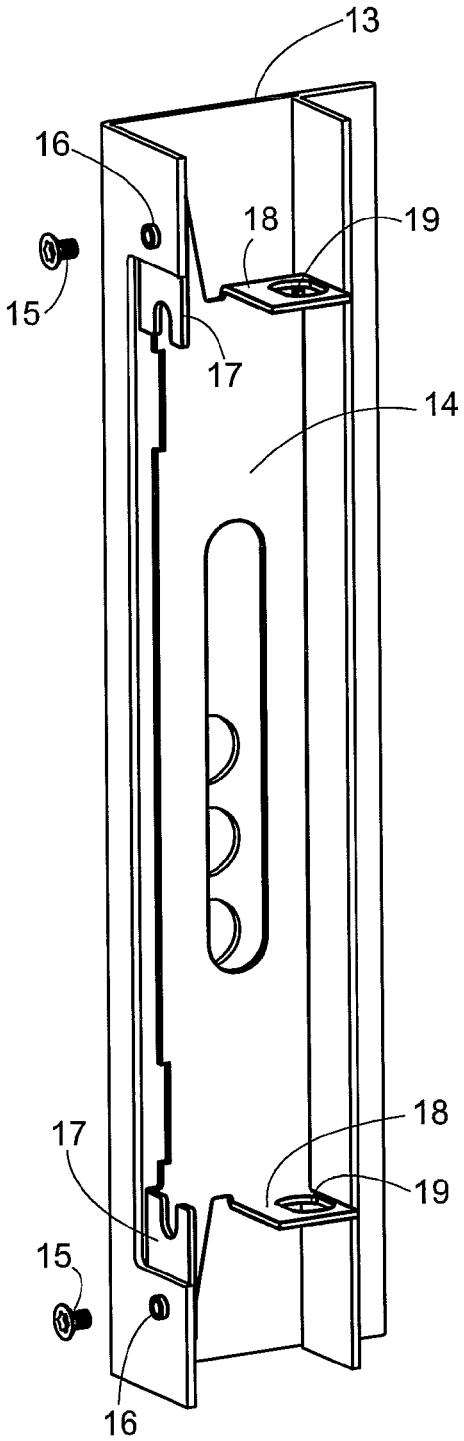
Figure 3:
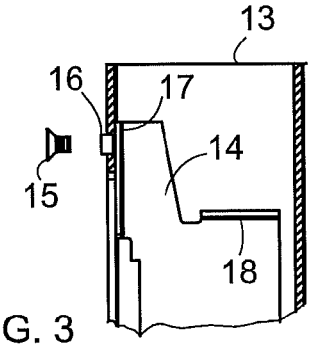
Figure 4:
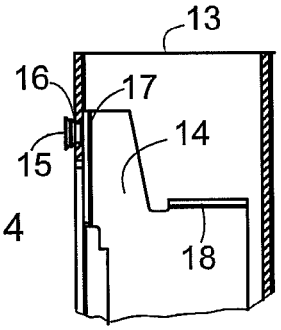
Figure 5:
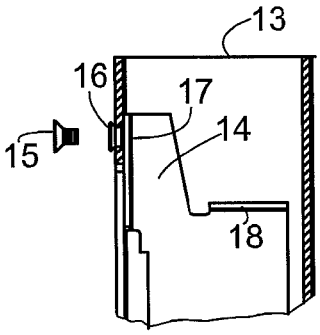
Figure 6:
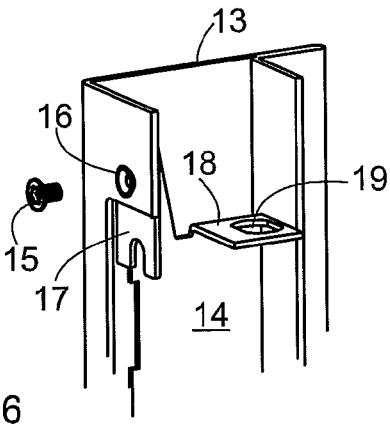
Figure 7:
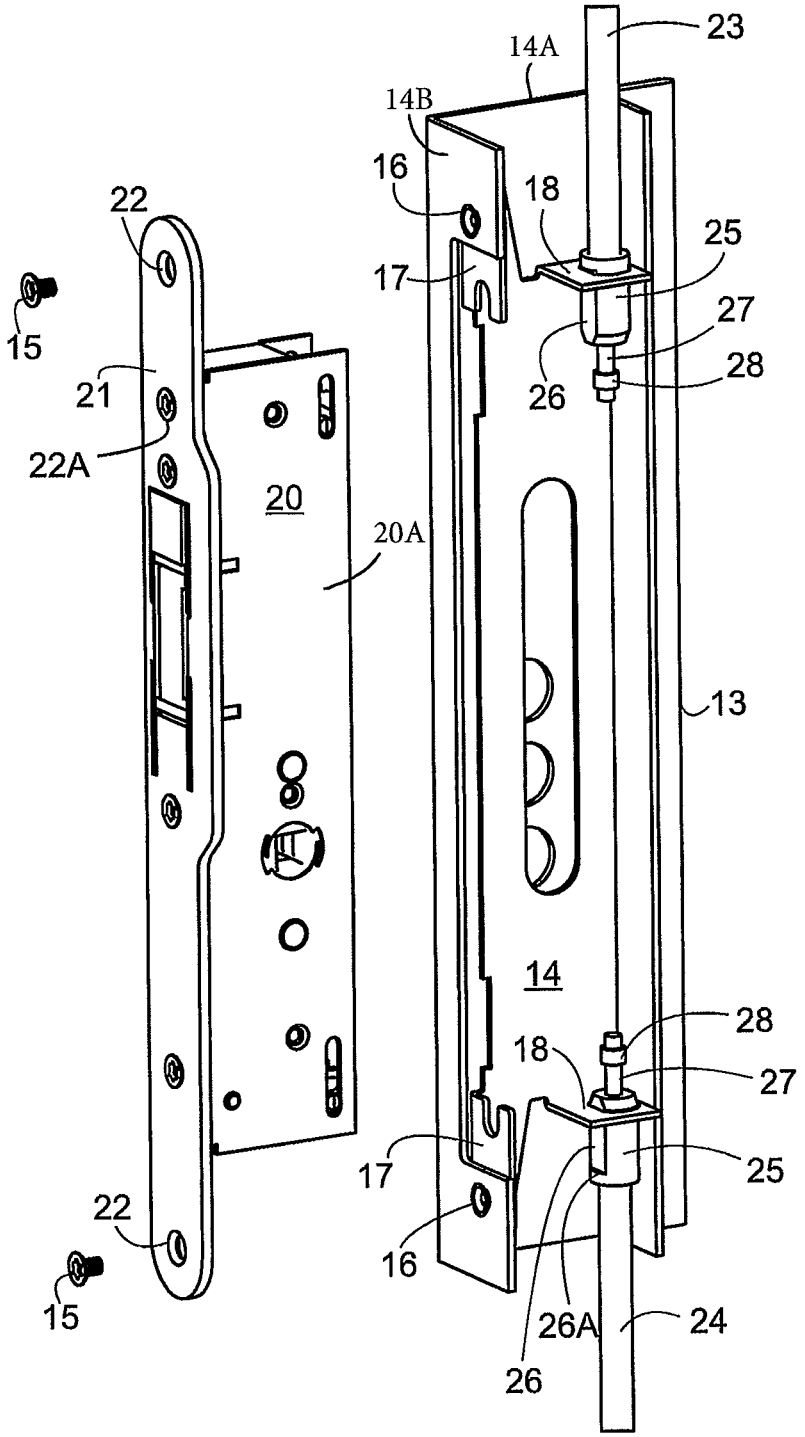
Figure 8:
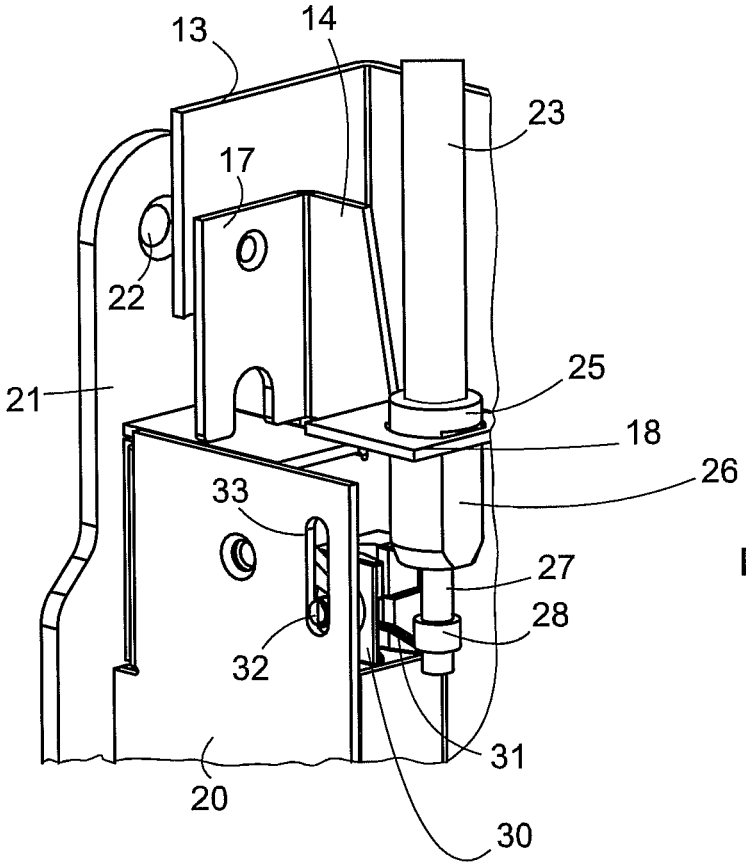
Figure 9:
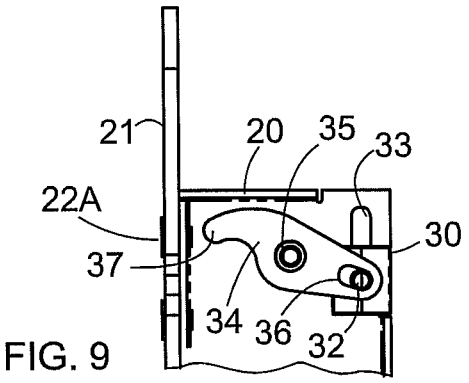
Figure 10:
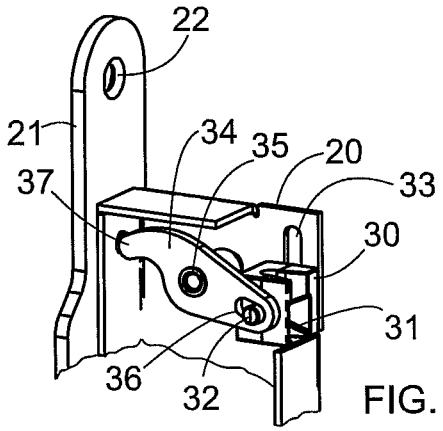
Figure 11:
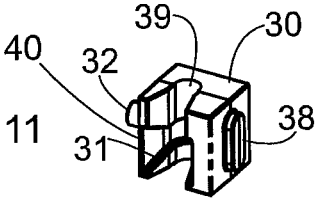
Figure 12:
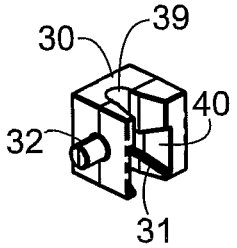
Figure 13:
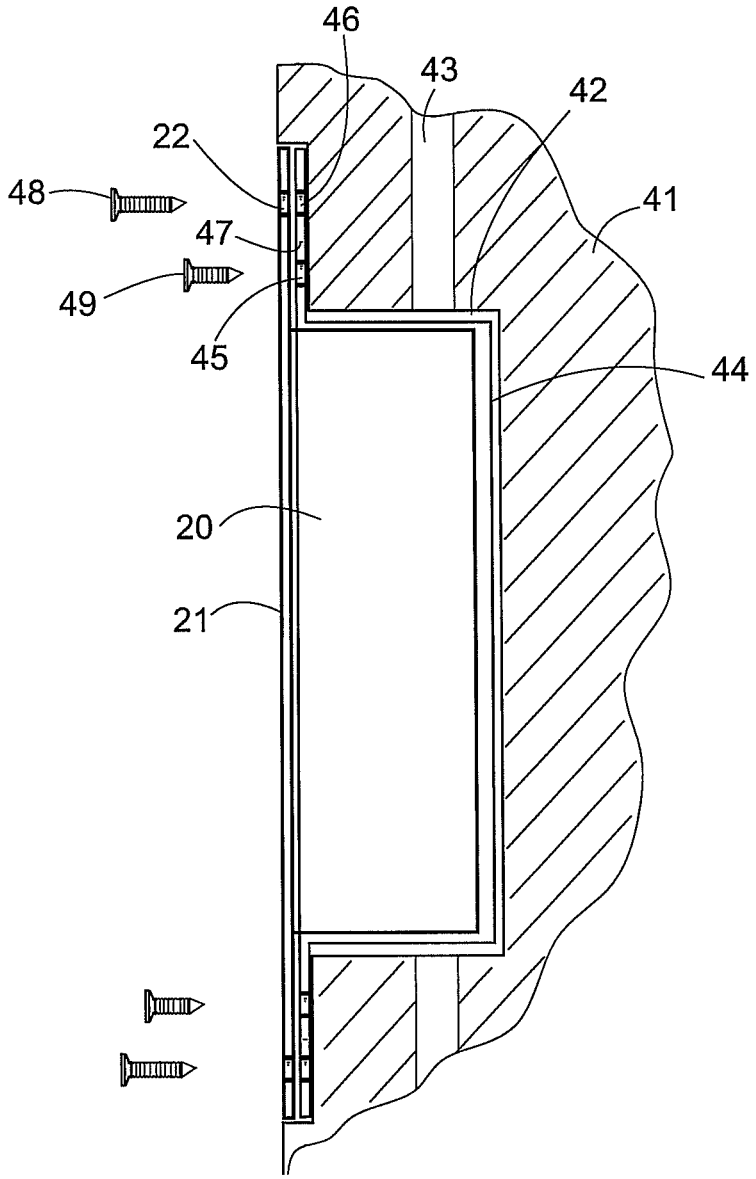

In the following the invention is described in more detail by reference to the attached figures, in which FIG. 1 shows an example of a known locking system for the passive door of a double door, FIG. 2 shows an example of an installation frame according to the invention, FIGS. 3 to 6 show an example of attaching the installation frame according to the invention to the door profile, FIG. 7 shows an example of arrangement according to the invention of an installation frame, pull bars and the lock body of the passive door, FIG. 8 shows in more detail the arrangement according to FIG. 7, FIGS. 9 to 10 show an example of the movable attachment arrangement of the pull bars according to the invention, FIGS. 11 to 12 show an example of the attachment part according to the invention being in connection with the lock body and FIG. 13 shows another example of an installation frame according to the invention,

DESCRIPTION

FIG. 2 shows an example of the installation frame 14 according to the invention. The installation frame comprises attachment means 16 for fastening the installation frame to the passive door blade and support means 18 for the attachment ends 25 of the pull bars. In this example the passive door blade is a metal profile door blade 13. Both support parts 18 of the example are provided with an opening 19 arranged to fit the contour of the outer surface of the attachment end 25 of the pull bar.

The attachment arrangements 16 are in the front side 17 of the installation frame. Because the door in question is a metal profile passive door blade, the installation frame can be arranged for installation inside the metal profile, as the example of FIG. 2 shows.

The attachment arrangements 16 can be collars extending from the front side 17 of the installation frame 14 inwards towards the rest of the installation frame. The attachment arrangements can also be collars extending from the front side 17 of the installation frame 14 outwards away from the rest of the installation frame. Collars 16 are fitted with fastening screws 15. When using outwards-extending collars it is preferable that the fastening screws 15 are countersunk screws.

FIGS. 3 to 6 show an example of the attaching of the installation frame according to the invention to the metal profile of the passive door blade. Outwards extending collars are used in the example. The installation frame is installed inside the metal profile so that the collars align with the holes in the metal profile (or bored later therein). In case of outwards-extending collars the collars are positioned in the holes.

The countersunk screws 15 are screwed onto the collars 16, whereby the outermost edge of both collars shapes to the form of the countersunk head of the screw. Thus, in this example the collars are arranged to be formed in this by, for example, by using a suitable material. When the installation frame (and the collars) are made of metal, a metal/alloy suitable for the purpose is used. When the countersunk screws are screwed away from the collars, the collars 16 with adapted form keep the installation frame attached to the metal profile of the passive door.

The collars are smooth without threads or they can also be provided with an internal thread. When the collar is not provided with threads, the fastening screws should be of the self-tapping type. A suitable thread for the screws and a possible inner threads is e.g. the M4 thread. In other embodiments, such as when using collars extending inside, the shape of the head of the fastening screw can be other than countersunk head.

After the installation frame has been fastened to the passive door blade, the pull bars 23, 24 are installed in the passive door. The pull bars comprise attachment ends 25 of the pull bars 23, 24 in the ends adjacent the lock body 20. Both support parts 18 comprise an opening 19 arranged to fit the contour of the outer surface of the attachment end 25. Thus the outer surface of the attachment end forms a support surface against the edge of the opening and the pull bars can be positioned in their place.

When the pull bars are in place, the lock body 20 can be put in the installation frame and fastened to the passive door blade. In the embodiments of the invention using outwards extending collars 16 the collars can be arranged to align with the fastening holes 22 in the front plate 21 of the lock body 20. This allows installing the lock body into the installation frame and fastening it to the passive door by means of the said countersunk screws. In other words, the same screws can be used for fastening both the installation frame and the lock body.

In embodiments using inwards extending collars the fastening holes of the front plate of the lock body are in different points.

FIG. 13 shows an embodiment of the installation frame 44 suitable for use in a passive door blade 41 having a wooden frame. The passive door blade with a wooden frame is provided with an installation chamber 42 for the installation frame 44 and installation chambers 43 for the pull bars. The front side of the installation frame 44 is provided with fastening arrangement i.e. holes 45 for the fastening screws 49. The installation frame 44 is fastened to the passive door by means of fastening screws.

In case the front part of the installation frame is wide enough (and not narrow 47, limiting to the vicinity of the fastening holes 45) it is preferable to provide second holes 46 for fastening the lock body 20. In this case the fastening holes 22 of the lock body 20 are arranged to align with the second holes. The lock body is fastened to the passive door by means of fastening screws 48. These features apply also in the embodiments using inwards-extending collars.

In order to be able to position the lock body to the installation frame, the lock body 20 is provided with attachment parts 30 for the attachment ends 25 of the pull bars. The attachment parts are arranged movably in the height direction of the lock body 20 and the attachment parts comprise mating surfaces 31, 40 for the attachment ends 25. The movability of the attachment parts makes it sure that they mate with the attachment ends so that the attachment ends and the attachment parts are located facing each other so that the release means 8 in connection with the lock body can be used for moving the pull bars via attachment parts. FIG. 8 shows the fastening of the attachment end 25 of the pull bar and the attachment part 30 to each other.

One embodiment of the attachment end 25 comprises an end pin 27 and a broader part 28 of the end pin 27. The broader part is arranged to fit together with the mating surfaces 31, 40 of the attachment part 30. The attachment end can be provided with at least one bevel 26. The bevel or bevels prevent the pull bar from rotating around its axis, in case the basic form of the attachment end is cylindrical. This can make the installation procedure in the other end of the pull bar easier. The bevel 26 of the guide head can be made so that it ends up with a threshold 26A in the end adjacent the pull bar 23, 24. The threshold prevents excessive extension of the pull bar towards the installation frame when the threshold hits the edge of the opening 19 of the support part 18. The purpose of this feature is also to make the installation procedure easier. Excessive extension of the pull bars can also be prevented if the outer surface of the guide head 25 of the pull bar is a partially conical surface, the conical surface widening towards the pull bar.

FIGS. 11 and 12 show the attachment part 30 in more detail. The attachment part comprises support parts 32, 38 arranged to be movably supported by the lock body 20 and a groove 39, the sides of which are provided with the said mating surfaces 31, 40. The mating surfaces form a perpendicular extension of the groove 39 in relation to the longitudinal direction of the groove. The longitudinal mating surface 40 of the groove 39 is formed to control and to be located against the edge of the broader part 28 of the end pin located parallel with the axis of the end pin 27 and the mating surface 31 perpendicular to the longitudinal direction of the groove 39 is arranged to control and to be against the side edges of the widening part 28.

Even though the groove 39 as such directs the broader part 28 towards the bottom of the groove and the actual joint (while the attachment part can move vertically), it is advantageous to be able to move the attachment part when the lock body is being positioned into the installation frame. Because of this the lock body 20 is provided with a path 22A for moving the attachment part 30 in relation to the lock body. The path can be, e.g., a screw hole in the front plate 22A of the lock body. When the screw is removed from the hole, the attachment part can be moved vertically with a suitable tool.

In the embodiment of FIGS. 11 and 12 the bottom 39 of the groove is narrower than the mouth of the groove. This makes it easier to align the broader part 28 of the attachment end to the groove. The support parts 32, 28 of the attachment part can be protrusions arranged to be supported by recesses 33 in the lock body 20.

FIGS. 9 and 10 show an embodiment for directing the attachment part 30 and for moving the attachment part during installation. The lock body 20 of the embodiment comprises a lever 34 pivoted 35 rotatably to the lock body at the center part of the lever. The first end 37 of the lever is on the side of the front plate 21 of the lock body seen from the middle of the lock body and the second end 36 is in connection with the attachment part 30. When the first end of the lever is facing the hole 22A in the front plate, it is easier to move the attachment part via the hole. Moving the first end rotates the lever, whereby the second end of the lever moves and simultaneously moves the attachment part. Thus the attachment part 30 can be more easily moved high enough (i.e. upwards in relation to the lock body 20) for catching the guide head 25. When the lock body is installed, the first end of the lever 37 is also controllable by means of the release means 8 via the transmission mechanism (not shown in the figures) so that the attachment part moves down, inwards in relation to the lock body 20. Thus the pull bar 23 can be controlled from the extended position to the retracted position. A corresponding arrangement is also provided in the lower part of the lock body for the lower pull bar.

The invention thus comprises a lock body 20 and two pull bars 23, 24. The lock body is arranged to be installed in the edge of the passive door blade facing the active door blade, and the pull bars are arranged to be installed to the passive door blade above and below the lock body 20. The arrangement further comprises an installation frame 14, 44 for the lock body, attachment ends 25 in the ends facing the lock body 20 of the pull bars 23, 24 and an attachment part 30 in the lock body. The installation frame 14, 44 has attachment arrangements 16, 45 for fastening the installation frame to the passive door blade as well as support parts 18 for the attachment ends 25 of the pull bars. The attachment parts 30 are arranged movably in the height direction of the lock body 20 and the attachment parts comprise mating surfaces 31, 40 for the attachment ends 25.

In the arrangement according to the invention the main installation order is: installation frame, pull bars and lock body. The installation frame allows aligning the pull bars to correct positions. The lock body can be removed from the passive door without removing the pull bars. Thus it is not necessary to remove the passive door blade from the doorway. It is also easy to exchange the lock body. Further, it is easier to service the lock body on location and it is also easy to transport it to the service company as there is no need to remove the whole passive door blade. In addition, the installation of the locking system of the passive door blade can be arranged more flexibly than in known solutions. The installation frame and the pull bars can be preinstalled at the door factory, whereby the lock frame can be installed later by a locksmith. Thus the locksmith and the final user still have the chance of selecting the desired model of the lock body for the passive door.

In light of the above examples it is obvious that the embodiment according to the invention can be realized in a number of ways. It is also obvious that the invention is not limited to the examples mentioned here, but that the invention can be realized within the scope of the appended claims.

The invention claimed is:

1. A locking system of a passive door blade of a double door, the system comprising: a lock body; an installation frame; and two pull bars, the lock body being arranged to be installed to an edge of the passive door blade facing an active door blade, the pull bars being arranged to be installed into the passive door blade above and below the lock body, wherein the installation frame is separate from the lock body and is configured to receive the lock body, attachment ends in the ends of the pull bars proximal to the lock body and attachment parts in the lock body, the installation frame being provided with attachment arrangements for fastening the installation frame to the passive door blade as well as with support parts for the attachment ends of the pull bars, said support parts formed directly from the further installation frame, the attachment parts being arranged movably in the height direction of the lock body and the attachment parts comprising mating surfaces for the attachment ends, wherein both support parts comprise an opening arranged to fit a contour of a outer surface of the attachment end while the outer surface of the attachment end forms a support surface against the edge of the opening and the attachment end comprising an end pin and a broader part of the end pin, the broader part being arranged to fit together with the mating surfaces of the attachment end, wherein the attachment part comprises support parts arranged to be movably supported by the lock body and a groove, the sides of which are provided with said mating surfaces, the mating surfaces forming an extension of the groove perpendicularly to the longitudinal direction of the groove, of which mating surfaces the mating surface parallel with longitudinal axis of the groove is formed to direct and to be positioned against the edge of the broader part of the end pin parallel with the axis of the end pin, and the mating surface perpendicular to the longitudinal direction of the groove being formed to direct and to be positioned against the side edges of the broader part of the end pin, and wherein the lock body comprises a lever rotatably pivoted to the lock body by a central part of the lever, a first end of the lever being on the side of the front plate of the lock body seen from the middle of the lock body and a second end being in connection with the attachment part.

2. The locking system according to claim 1, wherein the attachment arrangements are collars extending inwards towards the rest of the installation frame from the front side of the installation frame, the collars being fitted with fastening screws.

3. The locking system according to claim 1, wherein the attachment arrangements are collars extending outwards away from the rest of the installation frame from the front side of the installation frame, the collars being fitted with countersunk screws and arranged to be shaped like the countersunk head of the fastening screw.

4. The locking system according to claim 3, wherein the collars are arranged to align with fastening holes in the front plate of the lock body thus allowing the installation of the lock body to the installation frame and the fastening to the passive door by means of said countersunk screws.

5. The locking system according to claim 1, wherein the fastening arrangements are holes in the front side of the installation frame.

6. The locking system according to claim 5, wherein the front side of the installation frame is provided with second holes for fastening the lock body.

7. The locking system according to claim 1, wherein the attachment end is provided with at least one bevel.

8. The locking system according to claim 7, wherein the bevel of a guide head ends with a threshold in the end proximal to the pull bar.

9. The locking system according to claim 1, wherein the outer surface of the guide head is a partially conical surface.

10. The locking system according to claim 1, wherein a bottom of the groove is narrower than a mouth of the groove.

11. The locking system according to claim 1, wherein the support parts of the attachment part are protrusions arranged to be supported by indentations in the lock body.

12. A locking system, comprising:

a lock body, the lock body comprising attachment parts disposed within the lock body;

two pull bars, the pull bars comprising attachments ends in the ends of the pull bars proximal to the lock body; and an installation frame, separate from the lock body, configured to receive the lock body, for receiving the lock body, the installation frame comprising support parts for the attachment ends of the pull bars, said support parts formed directly from the installation frame, wherein the attachment parts are arranged movably in a height direction of the lock body and the attachment parts comprise mating surfaces attachable to the attachment ends of the two pull bars, and wherein the lock body comprises a lever rotatably pivoted to the lock body by a central part of the lever, a first end of the lever being on the side of the front plate of the lock body seen from the middle of the lock body and a second end being in connection with the attachment part.

13. The locking, system according to claim 12, wherein the mating surfaces are directly attached to the attachment ends of the two pull bars.

14. The locking system according to claim 12, wherein the lock body comprises a front plate fastened to the installation frame.

15. A locking system, comprising:

a lock body, the lock body comprising:

a front plate; and attachment parts disposed thereon;

two pull bars, the pull bars comprising attachments ends in the ends of the pull bars proximal to the lock body; and an installation frame for receiving the lock body, the installation frame comprising support parts for the attachment ends of the pull bars, said support parts formed directly from the installation frame, wherein the attachment parts are arranged movably in a height direction of the lock body and the attachment parts comprise mating surfaces attachable to the attachment ends of the two pull bars, and wherein the front plate of the lock body is attached to the side portion of the installation frame, and wherein the lock body comprises a lever rotatably pivoted to the lock body by a central part of the lever, a first end of the lever being on the side of the front plate of the lock body seen from the middle of the lock body and a second end being in connection with the attachment part.

16. A locking system of a passive door blade of a double door, the system comprising:

a lock body arranged to be installed to the passive door blade;

two pull bars, the pull bars being arranged to be installed into the passive door blade above and below the lock body, the pull bars comprising attachment ends at ends of the pull bars proximal to the lock body; and an installation frame separate from the lock body and configured to receive the lock body, the installation frame comprising:

attachment arrangements for fastening the installation frame to the passive door blade; and support parts for the attachment ends of the pull bars, said support parts formed directly from the further installation frame and extend perpendicularly from the installation frame, wherein the lock comprises a lever rotatably pivoted to the lock body by a central part of the lever, a first end of the lever being on the side of the front plate of the lock body seen from the middle, or the lock body and a second end being in connection with an attachment part of the lock body.

17. The locking system according to claim 16, wherein the attachment arrangements comprise collars extending from a front side of the installation frame toward the installation frame and configured to receive a fastener.

18. The locking system according to claim 17, wherein the collars are aligned with fastening holes in a front plate of the lock body.

19. The locking system according to claim 16, wherein the attachment parts are arranged movably in the height direction of the lock body and the attachment parts comprising mating surfaces for the attachment ends.

20. The locking system according to claim 16, wherein the support parts comprise an opening arranged to fit a contour of an outer surface of the attachment end while the outer surface of the attachment end forms a support surface against the edge of the opening and the attachment end comprising an end pin and a broader part of the end pin, the broader part being arranged to fit together with the mating surfaces of the attachment end.

21. The locking system according to claim 1, wherein the installation frame and the lock body are separately installable into the passive door blade.

* * * * *